US005992854A

United States Patent [19]

Flory et al.

[11] Patent Number: 5,992,854

[45] Date of Patent: Nov. 30, 1999

[54] CARD GAME

[76] Inventors: Meredith Irwin Flory; Rex William Flory, both of 6044 Ensign Ave., North Hollywood, Calif. 91606

[21] Appl. No.: 09/092,968

[22] Filed: Jun. 8, 1998

[51] Int. Cl.[6] ..... A63F 1/00

[52] U.S. Cl. ..... 273/293; 273/294; 273/292; 273/138.1; 273/249; 472/73

[58] Field of Search ..... 273/293, 294, 273/292, 138.1, 249; 472/73, 72

[56] References Cited

U.S. PATENT DOCUMENTS 1,666,448 4/1928 Hardenstein ..... 273/292
2,881,537 4/1959 Dreman ..... 273/292
3,630,866 12/1971 Kerr ..... 273/293
5,524,898 6/1996 Pavlovic ..... 273/293

*Primary Examiner*—Benjamin H. Layno

[57] ABSTRACT

A card game in which luck and chance play little or no part in determining the outcome; skill, memory, and deception determine the winner. There are two sets or decks of cards. Each player has his own set of cards. Each set is comprised of nine cards, identical in size, shape (square), and color. Each card has identical indicia on its face. The cards differ only in the number of indicia on each card from zero (a blank card) to eight. The indicia are uniformly placed on the cards in the corners sequentially from one to four, and on the sides, from five to eight. The placement of the indicia enables a player to masquerade one card for another by hiding one or none of the indicia on a card with his thumb or finger.

9 Claims, 6 Drawing Sheets

CARD GAME

FIELD OF THE INVENTION

The present invention generally relates to games and more particularly cards which are used in which luck or chance is minimized and skill and strategy is maximized in determining a winner.

BACKGROUND OF THE INVENTION

Heretofore, most board and card games depend on a roll of the dice, spin of the wheel, or luck of the draw to influence the outcome of the game. Part of their novelty is that with luck anyone can win. Card games generally rely on luck of the draw and skill to determine an outcome. We wish to provide a card game whose methods of use depends on skill and strategy, not primarily on luck.

We have conducted a novelty search of the prior art and note the following as being the most relevant: U.S. Pat. No. 5,388,830; U.S. Pat. No. 4,443,012; U.S. Pat. No. 3,263,999; U.S. Pat. No. 2,748,500; U.S. Pat. No. 2,652,635; U.S. Pat. No. 2,457,020; U.S. Pat. No. 645,961; U.S. Pat. No. 253, 895; U.S. Design Pat. No. D62,466; U.S. Design Pat. No. D59,761; and U.K. Patent No. 634,712. However, none of these patents discloses the essence of this invention, namely, a card game which comprises a series of identically shaped cards (hereinafter called "cheat cards") bearing identical indicia but each cheat card differing in the number of indicia from one to eight (or from one to any number) in sequence, plus a blank card, and which permits a player to hide, or not hide, one of the indicia on a particular card, in order to attempt to mislead his opponent as to the number of indicia on that particular card.

SUMMARY OF THE INVENTION

Accordingly, several objects and advantages of my invention are that luck and chance play only little part in determination of the outcome; skill, memory, and deception determine the winner.

The game of our invention employs cards wherein the principle of the game is to trick your opponent into believing you have a card in your hand which you do not.

The game is played with a number of cards which are identical in shape, and differ only in the number of indicia on each card. In one form of the game, each player initially is given nine (9) cards, as shown in FIG. 1. The game may also be, satisfactorily, played with a lesser number of cards, e.g., five (5).

Each card, in sequence, commences from zero indicia (a blank card), and thence from one—to, say, eight indicia. In the example, each individual indicia is a single black dot, but could be a cross or other geometric form so long as the indicia are identical in shape and color.

Each card in the sequence differs from its preceding card by a single indicia and differs from its next succeeding card by a single indicia so that when, by way of example, card 41 (a one-spot card) is shown to the opponent, with the thumb over the corner (FIG. 4), it may be, possibly either a two-spot card or a one-spot card. It is up to the opponent to guess which card the player is presenting. If he guesses correctly, he wins the "point" and advances on the game board (see FIG. 20).

DETAILED DESCRIPTION OF THE INVENTION

Figure 1:
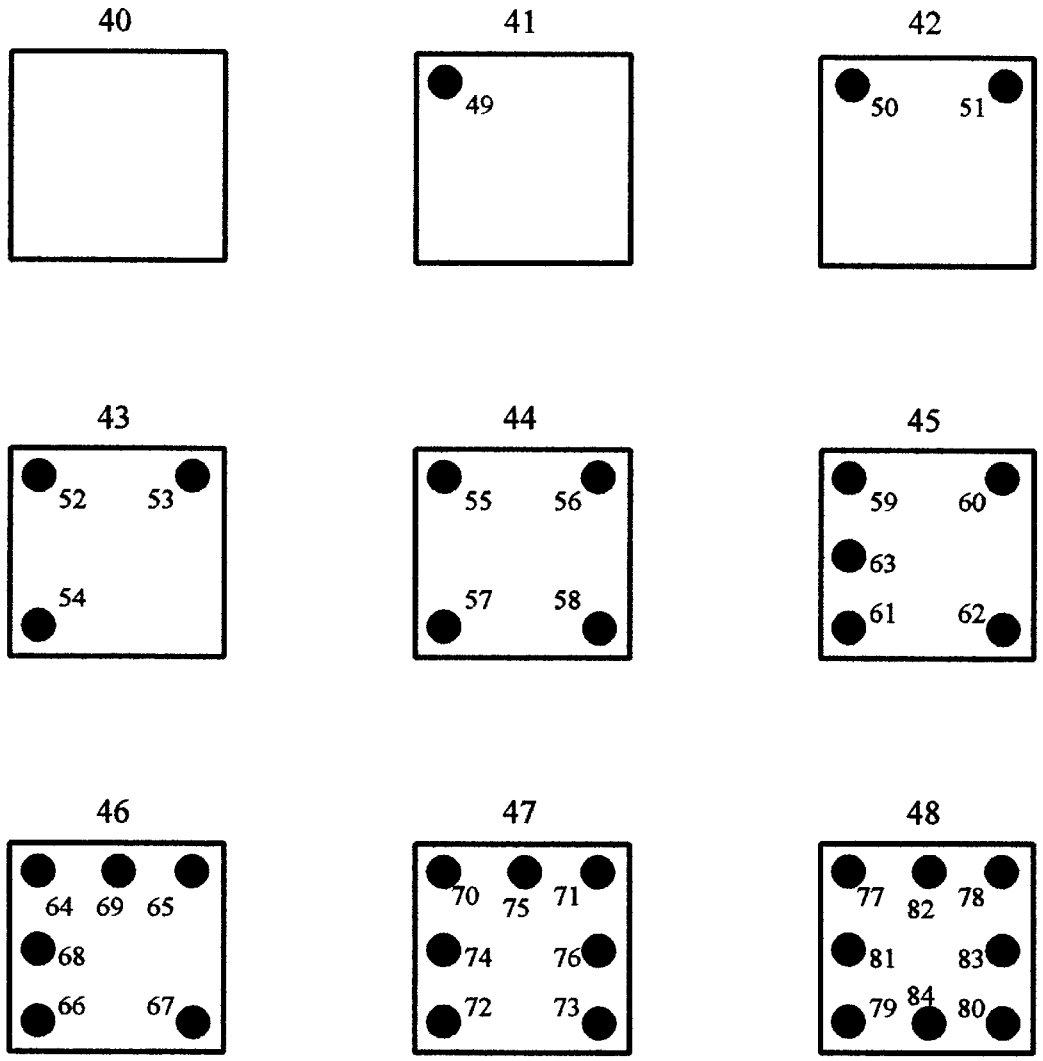
FIG. 1 is a top view of a first preferred embodiment of the 9 card set of cheat cards.
Figure 2:
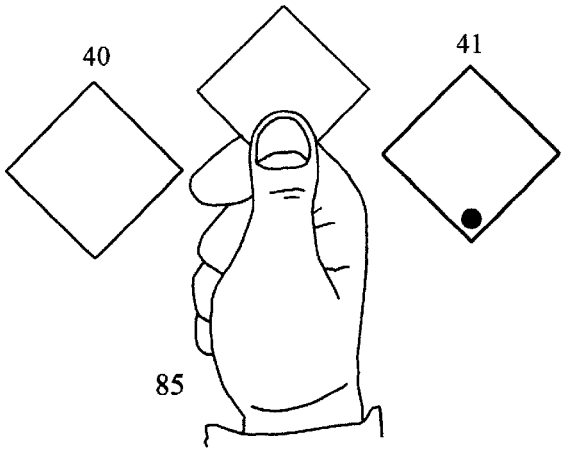
FIG. 2 is a top view of a second preferred embodiment of either the blank card 40 or the one card 41 being presented by hand in the playing position 85. When presented in this way, either card can masquerade as the other.
Figure 3:
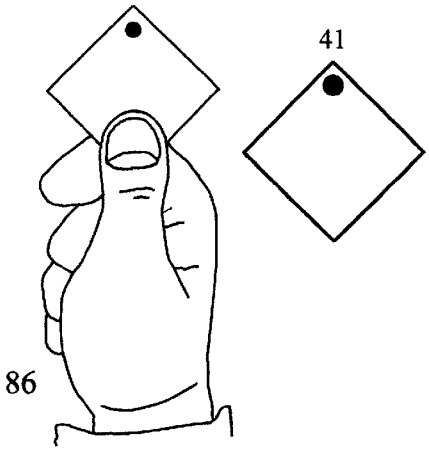
FIG. 3 is a top view of one card 41 being presented by hand in an incorrect playing position 86. When presented in this way there can be no deception. It cannot masquerade as either the blank card or the two card, it can only be a one. It's a fool's play.
Figure 4:
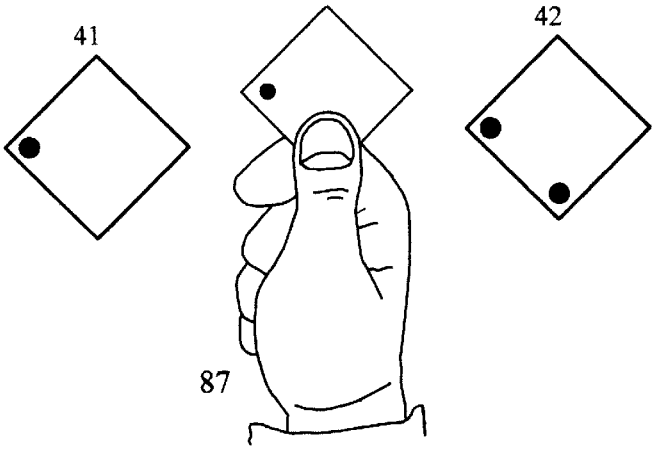
FIG. 4 is a top view of a second preferred embodiment of either the one card 41 or the two card 42 being presented by hand in the playing position 87. When presented in this way, either card can masquerade as the other.

Now referring more particularly to FIG. 1, of the drawings, a first preferred embodiment of the set of nine cheat cards comprising the present invention, is shown. The nine cheat cards are identical in size, shape, thickness, and color, the only difference between them being the presence or absence of one or more black spots. The standard cards are two inches square. The spots are five sixteenths of an inch in diameter, and are centered ⅜ inch from the corner (measured on the diagonal).

The set of nine cheat cards comprises a blank 40 having no spots, a one card 41 having one spot 49, a two card 42 having two spots, 50, 51, on adjacent corners, a three card 43 having three spots, 52, 53, 54, a four card, 44, having four spots, 55, 56, 57, 58, a five card, 45, having five spots, 59, 60, 61, 62, 63. The fifth spot 63 one of the five card 45 is centered halfway between the centers of spots 59 and 61. A six card, 46, having six spots, 63, 64, 65, 66, 67, 68. The sixth spot 68 on the six card 46 is centered halfway between the centers of spots 63 and 64. A seven card, 47, having seven spots, 69, 70, 71, 72, 73, 74, 75. The seventh spot 75 on the seven card 47 is centered halfway between the centers of spots 70 and 72. The eight card, 48, having eight spots, 76, 77, 78, 79, 80, 81, 82, 83. The eight spot 83 on the eight card 48 is centered halfway between the centers of spots 78 and 79.

Figure 7:
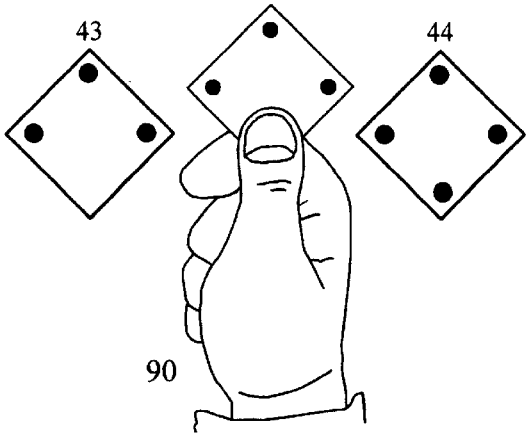
FIG. 7 is a top view of a second preferred embodiment of either the three card 43 or the four card 44 being presented by hand in the playing position 90. When presented in this way, either card can masquerade as the other.
Figure 8:
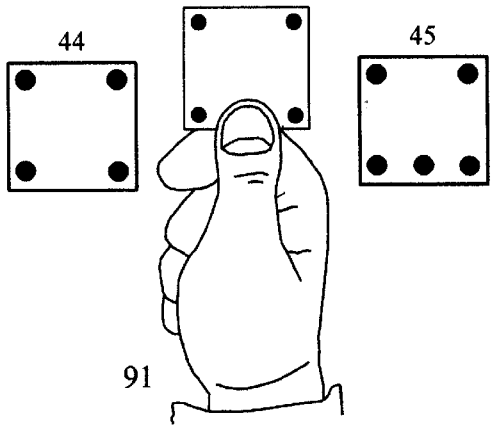
FIG. 8 is a top view of a second preferred embodiment of either the four card 44 or the five card 45 being presented by hand in the playing position 91. When presented in this way, either card can masquerade as the other.
Figure 9:
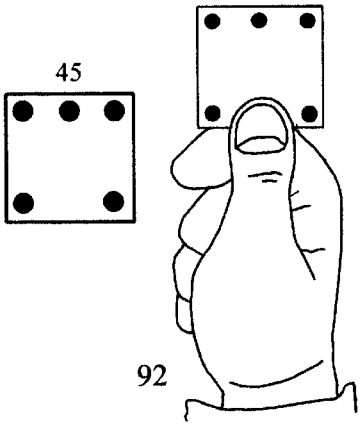
FIG. 9 is a top view of the five card 45 being presented by hand in an incorrect playing position 92. It can only be the five card. It's a fool's play.
Figure 10:
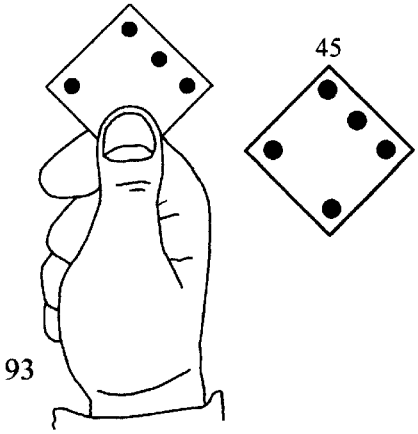
FIG. 10 is a top view of the five card 45 being presented by hand in an incorrect playing position 93. Its's a fool's play.
Figure 11:
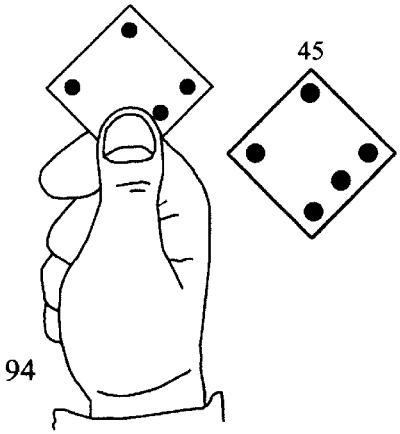
FIG. 11 is a top view of the five card 45 being presented by hand in an incorrect playing position 94. It's a fool's play.
Figure 12:
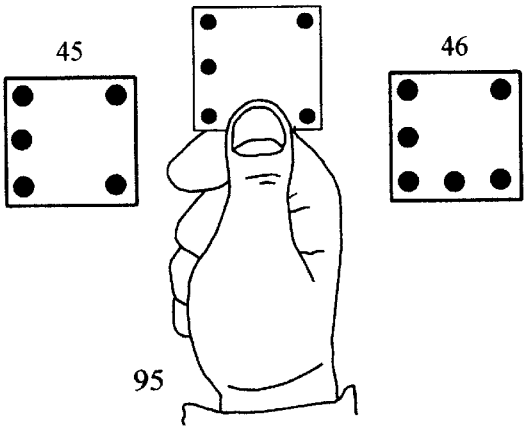
FIG. 12 is a top view of a second embodiment of either the five card 45 or the six card 46 being presented by hand in the playing position 95. When presented in this way, either card can be masquerade as the other.
Figure 13:
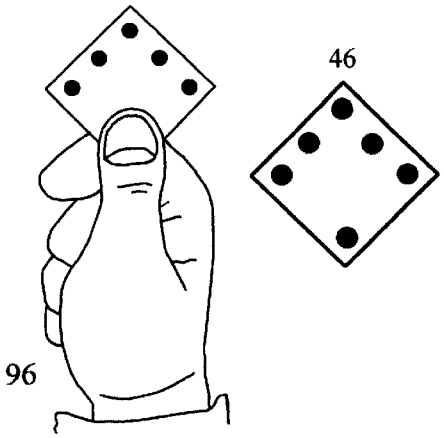
FIG. 13 is a top view of a six card 46 being presented by hand in an incorrect playing position 96. It can only be the six card. It's a fool's play.
Figure 14:
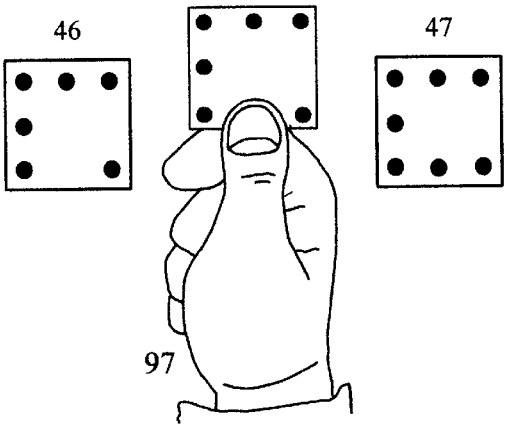
FIG. 14 is a top view of a second preferred embodiment of either the six card 46 or the seven card 47 being presented by hand in the playing position 97. When presented in this way, either card can masquerade as the other.
Figure 15:
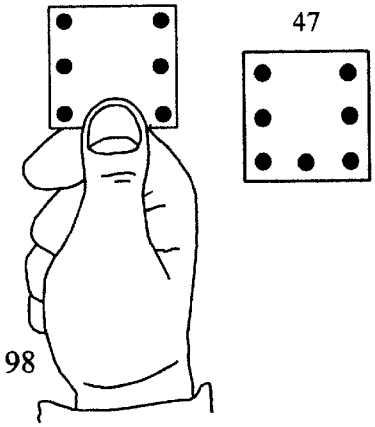
FIG. 15 is a top view of the seven card 47 being presented by hand in an incorrect playing position 98. It can only be the seven card. It's a fool's play.
Figure 16:
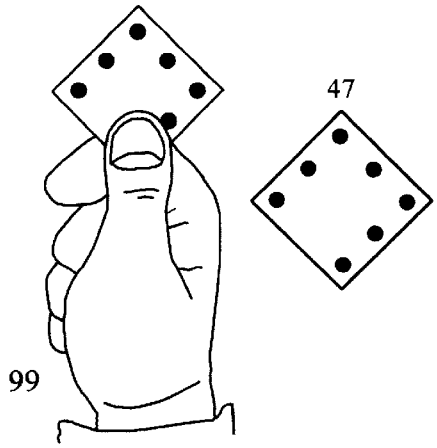
FIG. 16 is a top view of the seven card 47 being presented by hand in an incorrect playing position 99. It's a fool's play.
Figure 17:
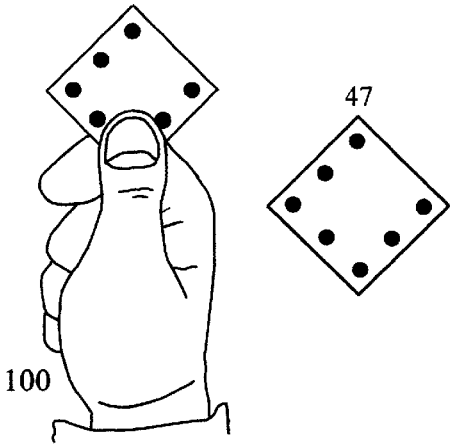
FIG. 17 is a top view of the seven card 47 being presented by hand in an incorrect playing position 100. It's a fool's play.
Figure 18:
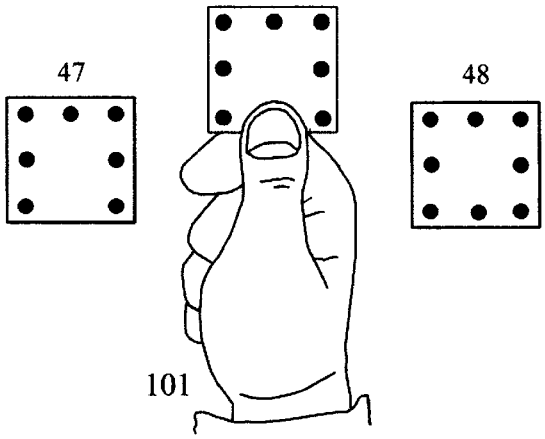
FIG. 18 is a top view of a second preferred embodiment of either the seven card 47 or the eight card 48 being presented by hand in the playing position 101. When presented in this way, either card can masquerade as the other.
Figure 19:
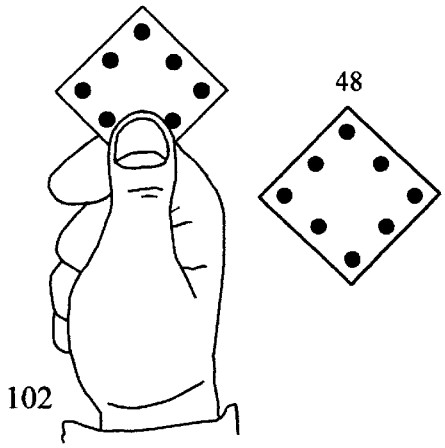
FIG. 19 is a top view of the eight card 48 being presented by had in an incorrect playing position 102. It's a fool's play.

Each player has his own set of nine cheat cards at the beginning of play. He allows no one else to touch them. One tiny nick on the face of a card can be the difference between winning and losing. The principle of the game, which we call CHEAT, is that there is either a spot under a player's thumb or there is not. For example, observe FIG. 7. The player is holding out a card face up parallel to the table. Three spots are showing. He is playing either his three card or his four card.

As he holds out the card he calls it either a three or a four. It is up to his opponent to decide whether he is lying or telling the truth. The Opponent can say, "Go," if he thinks the player is telling the truth, or if he thinks he is lying he can say, "Cheat." If he says, "Cheat," the player must lay the card face up on the table and remove his thumb from the card. If he is telling the truth and the spots equal his call he gets one move on the board (FIG. 20) but if he is cheating his opponent gets one move on the board. If the opponent says, "Go," and the player is telling the truth, he turns the card face down on the table without revealing its value. Nobody moves on the board. However, if the player is cheating, he can remove his thumb from the card, revealing its true value, and move one space on the board (FIG. 20).

The first player to move seven spaces is the winner. If the loser fails to move four spaces he must pay double, or other penalty.

Figure 20:
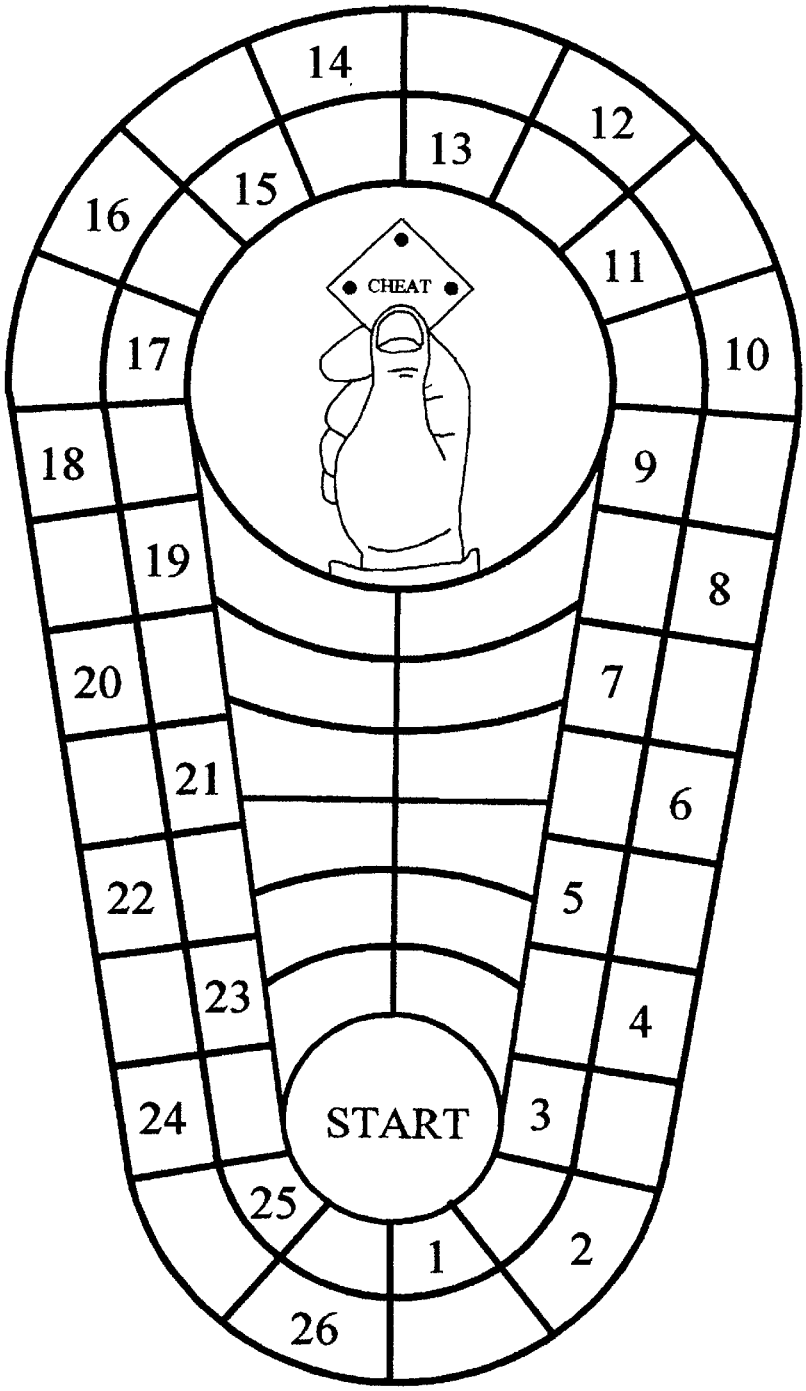
FIG. 20 is a top view of the cheat board. The start circle and the winners circle containing the cheat logo are connected by two columns of six spaces each. This is the playing field for STRAIGHT CHEAT. The numbered spaces encircling the playing field are used for another variation of the game called ODDS (hereinafter described).

STRAIGHT CHEAT is a two handed game the object of which is to mark, that is, to be the first to move one's marker from the Start circle in FIG. 20 over six spaces and into the CHEAT circle, seven moves in all. A game consists of any number of marks agreed upon before a play begins. Flip a coin to see who plays first. For clarity lets say green plays first; and black plays second.

Green may call blank, one, two, three or four, holding out the card as in FIG. 1, face-up in full view until Black says either "Go" or "Cheat." There are five possible plays.

Play One

When Green is not cheating and Black says, "Go," Green lays the card face down on the table so that Black cannot see what it is. No markers are moved.

Play Two

Green is not cheating and Black says, "Cheat." Green lays the card face up on the table, removes his thumb from the corner showing he is not cheating, and moves his marker one space on the board.

Play Three

When Green is cheating and Black says "Go," Green lays the card face up on the table, removes his thumb from the corner and takes a move of one space on the board.

Play Four

When Green is cheating and Black says, "Cheat," Green must lay the card face up on the table and remove his thumb from the corner. Black wins a move of one space on the board. Black always moves in the right lane, Green in the left.

Play Five

Green is cheating, and Black says, "Go," but instead of showing the card and taking a move on the board as in Play Four, Green turns the card over as in Play One. This is the Finesse, and it may be used because a move on the last card played by either player is three spaces instead of one.

Figure 5:
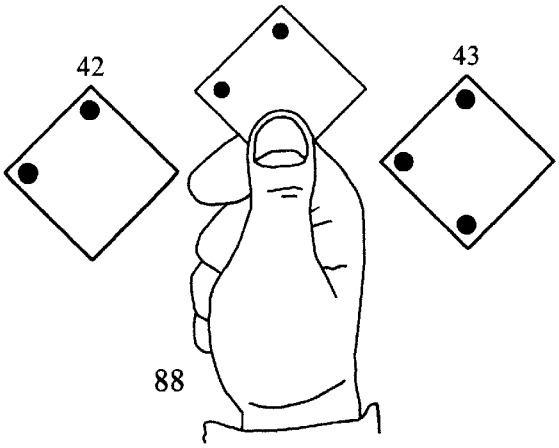
FIG. 5 is a top view of a second preferred embodiment of either the two card 42 or the three card 43 being presented by hand in the playing position 88. When presented in this way, either card can masquerade as the other.
Figure 6:
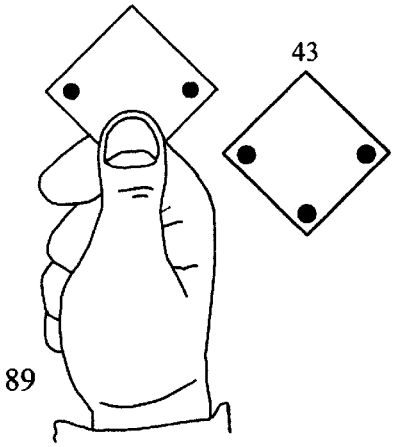
FIG. 6 is a top view of three card 43 being presented by hand in an incorrect playing position 89. When presented in this way there can be no deception. It's a fool's play.

For example, on an early move Green plays his three card as in FIG. 5 and calls, "Two." Black says, "Go," and Green turns the card face down as if it were a two instead of showing it to be a three and moving a space on the board. Then on the last card Green plays the two card and again calls, "Two." If the finesse works, Black will say, "Cheat," Green will show the card to be a two and move three spaces on the board. But if Black says, "Go," Green can only turn the card down, having blown the space he could have picked up earlier after his successful cheat on the three card.

Play is alternating; Green, Black etc., until every card has played or someone has marked. If no one has marked, the cards are picked up and play resumes in the same order until someone marks.

After each card is played it is placed face down in front of the player and may not be touched again until all cards are picked up at the end of the hand or when someone marks, except for incidental contact when the next-played card is stacked face down on top of it. Under no circumstances may a player touch an opponent's card.

QUICK CHEAT is played with only one set of CHEAT cards. The player with the cards plays until he is either caught cheating, cheats successfully or is telling the truth on a cheat call.

In the game of ODDS both players have two markers, one for the inside STRAIGHT CHEAT columns and the other for the outer track of numbered spaces. The inside track is used the same as in STRAIGHT CHEAT, to keep score of the points won. The outside track is for keeping the players "call" marker on an odd number. In ODDS each player must always "call" an odd number. If caught cheating, the player's marker will end up on an even number giving his opponent a point. The first play of the game must be either a call of one or three. If the call is either uncontested or truthful the player moves his counter to the appropriate space. He must then continue to call an odd sum total of all his played cards until either he or his opponent marks. Play alternates and each player must keep his marker on an odd sum.

We claim:

1. A card game which comprises a series of identically shaped cards bearing only identical indicia but each card differing in the number of indicia from one to any higher number in sequence, plus a blank card, having no indicia, each card being identically divided into a plurality of areas wherein each of said cards having a mixture of areas with no indicia and areas having indicia placed thereon, and the indicia being so placed on certain area on the cards and of such a size so as to enable a player to hide, or not hide, one of the indicia on a particular card by covering an area on the card with the player's thumb or finger, the covered area either having an indicia or not having an indicia in order to attempt to mislead his opponent as to the number of indicia on that particular card.

2. The card game of claim 1 wherein the identical indicia are spots differing in color from the background field of the cards.

3. The card game of claim 1 wherein the identical indicia are crosses differing in color from the background field of the cards.

4. The card game of claim 1 wherein the cards are square in shape.

5. The card game of claim 1 wherein the indicia of each card bearing four or less of the identical indicia are placed in the corner or corners of each card.

6. The card game of claim 1 wherein the indicia of each card bearing five or more of the identical indicia are placed both in the corners of each card and also at places intermediate the corners but not in or near the center of each of the cards.

7. The card game of claim 1 wherein the identical indicia constitutes depressions in the cards.

8. The card game of claim 1 wherein the identical indicia constitute protrusions in the cards.

9. The card game of claim 1 wherein the indicia on the cards number from one to eight.

* * * * *